US009205904B2

(12) United States Patent
Asada et al.

(10) Patent No.: US 9,205,904 B2
(45) Date of Patent: Dec. 8, 2015

(54) MULTI-AXIS WATER JET PROPULSION USING COANDA EFFECT VALVES

(75) Inventors: Haruhiko Harry Asada, Lincoln, MA (US); Anirban Mazumdar, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 142 days.

(21) Appl. No.: 13/366,659

(22) Filed: Feb. 6, 2012

(65) Prior Publication Data

US 2012/0282826 A1 Nov. 8, 2012

Related U.S. Application Data

(60) Provisional application No. 61/482,272, filed on May 4, 2011.

(51) Int. Cl.

| | |
|---|---|
| ***B63H 11/107*** | (2006.01) |
| ***B63H 11/00*** | (2006.01) |
| ***B63H 11/04*** | (2006.01) |
| ***B63H 11/103*** | (2006.01) |

(52) U.S. Cl.

CPC ..... *B63H 11/04* (2013.01); *B63H 11/103* (2013.01); *Y10T 29/49236* (2015.01)

(58) Field of Classification Search

CPC ..... B63H 11/04; B63H 11/08; B63H 11/103; B63H 11/11; B63H 11/107; B63H 2011/002; B63B 35/731; Y10T 29/49236

USPC ..... 440/38, 39, 40, 42, 43; 114/337; 137/831, 565.11

See application file for complete search history.

(56) References Cited

U.S. PATENT DOCUMENTS

| | | | | |
|---|---|---|---|---|
| 3,521,653 | A * | 7/1970 | Zoya et al. | 137/831 |
| 3,797,527 | A | 3/1974 | Bain | |
| 3,995,662 | A * | 12/1976 | Fitzgerald et al. | 137/825 |
| 4,413,795 | A | 11/1983 | Ryan | |
| 4,549,574 | A * | 10/1985 | Taylor | 137/565.11 |
| 5,067,509 | A | 11/1991 | Hunter | |
| 5,112,007 | A | 5/1992 | Buchele-Buecher | |
| 5,574,246 | A | 11/1996 | Meyers et al. | |
| 5,758,592 | A | 6/1998 | Benson, Jr. | |
| 6,581,537 | B2 | 6/2003 | McBride et al. | |
| 7,096,888 | B1 * | 8/2006 | Thurston et al. | 137/818 |
| 7,290,496 | B2 | 11/2007 | Asfar et al. | |

(Continued)

FOREIGN PATENT DOCUMENTS

| | | |
|---|---|---|
| GB | 2442712 | 4/2008 |
| GB | 2442770 | 4/2008 |
| WO | 2004041068 | 5/2004 |

OTHER PUBLICATIONS

Mackenzie et al., "Robotic Inspection System for Non-Destructive Evaluation (NDE) of Pipes" 2009 American Institute of Physics vol. 28, pp. 1687-1694.

(Continued)

*Primary Examiner* — Anthony Wiest
(74) *Attorney, Agent, or Firm* — Gesmer Updegrove LLP

(57) ABSTRACT

A propulsion system is provided that includes one or more pumps that form a jet for propulsion. A number of Coanda jet devices (CJDs) are coupled to the one or more pumps. The CJDs are arranged so to allow for a multi-axis underwater control of an underwater robot.

24 Claims, 9 Drawing Sheets

(56) References Cited

U.S. PATENT DOCUMENTS

| | | | | |
|---|---|---|---|---|
| 2001/0021613 | A1 | 9/2001 | Fadeley et al. | |
| 2009/0211511 | A1 * | 8/2009 | Shen | 114/337 |

OTHER PUBLICATIONS

Buckingham et al., "Snaking around in a nuclear jungle" The Industrial Robot, 2005, 32, 2, pp. 120-127.

Mazumdar et al., "A Compact Underwater Vehicle Using High-Bandwith Coanda-Effect Valves for Low Speed Precision Maneuvering in Cluttered Environments" IEEE, May 2011.

SeaBotix, Inc., "The SeaBotix LBV MiniROV systems are widely used within the Nuclear industry for various contaminated water inspections" 2011, 2 pages.

European Search Report issued on Sep. 7, 2012 in connection with European Patent Appln. No. 12165828.0-2422.

* cited by examiner

MULTI-AXIS WATER JET PROPULSION USING COANDA EFFECT VALVES

PRIORITY INFORMATION

This application claims priority from provisional application Ser. No. 61/482,272 filed May 4, 2011, which is incorporated herein by reference in its entirety.

BACKGROUND OF THE INVENTION

The invention is related to the field of underwater vehicle propulsion and maneuvering, and in particular to a system for propelling and orienting an underwater robot without the use of conventional propeller thrusters.

Since the 1990s, underwater vehicles have become a very popular approach for a number of industrial applications. For example underwater robots have played a major role in the search for undersea wrecks and in the repair of damaged underwater oil risers. Recently there has emerged a new application for such robots: industrial piping systems such as those used for the cooling cycle in nuclear reactor systems. For these applications, the robot must carry a camera or other sensor array and be able to maneuver precisely within the confines of the pipe. For these types of inspections the speed of the robot is actually quite slow. This is to ensure that the robot operator is able to carefully and thoroughly examine the images in real time.

Typical underwater robots use a set of five separate propeller thruster devices. These thrusters are driven by electric motors and have proven quite robust and useful for many applications. However, for certain applications this approach is not desirable. The large number of motors adds considerable mass and volume to the robot. In addition, thrusters exhibit nonlinearities which make them difficult to control when operating at very low speeds or when required to turn on and off rapidly. Finally, reversing the direction of a propeller (something that would be required for fine maneuvers) exerts substantial reaction moments on the body of the vehicle.

SUMMARY OF THE INVENTION

According to one aspect of the invention, there is provided a propulsion system. The propulsion system includes one or more pumps that form a jet for propulsion. A number of Coanda jet devices (CJDs) are coupled to the one or more pumps. The CJDs are arranged so to allow for a multi-axis underwater control of an underwater robot.

According to another aspect of the invention, there is provided a method of forming a propulsion system. The method includes providing one or more pumps that form a jet for propulsion. Moreover, the method includes coupling a plurality of CJDs to the one or more pumps. The CJDs are arranged so to allow for a multi-axis underwater control of an underwater robot.

According to another aspect of the invention, there is provided a method of performing the operation of a propulsion system. The method includes forming a jet for propulsion using one or more pumps. Also, the method includes providing multi-axis underwater control using a plurality of CJDs. The CJDs are coupled to the one or more pumps.

DETAILED DESCRIPTION OF THE INVENTION

The present invention is a jet based approach to multi-axis underwater propulsion and maneuvering, but incorporates a set of custom high speed and compact valves based on well known fluidics technology. Like the previous work on water jet actuation, the underwater vehicle contains an onboard pump and several exit ports. A valve system enables the operator to choose which direction and axis to apply force and moments. Specifically vehicle translation and rotation can be controlled in several axes. Several maneuvering architectures are described herein.

However for the inventive design, a different type of valve is used. A Coanda effect valve based on fluidics technology is used as a valve, allowing the direction of the exit jet to be controlled in a high speed yet compact way.

This invention is unique in several key ways. Most significantly, the invention is specifically designed for multi-axis underwater vehicle control instead of simply switching between two outputs. This architecture uses a number of valves to create forces and moments that can result in translations and rotations along multiple axes. Additionally, the use of a diffuser nozzle to create a null configuration is novel. This allows the pump to remain on while applying zero force or moment to the vehicle. Also, the vehicle to remain stationary momentarily without dealing with the implications of switching the rotary pump on and off repeatedly.

Finally, the specific implementation of the Coanda effect valve is unique. First, the device was designed for use in water alongside a micropump. The geometry of the device therefore differs substantially from the prior art. Additionally, a mechanical design was incorporated that enables the switching of the jet with a single solenoid. This innovation reduces size, weight, and complexity. For the sake of simplicity this entire device is chosen as a CJD. The CJD structure can even be implemented as part of a robot structure itself.

Figure 1:
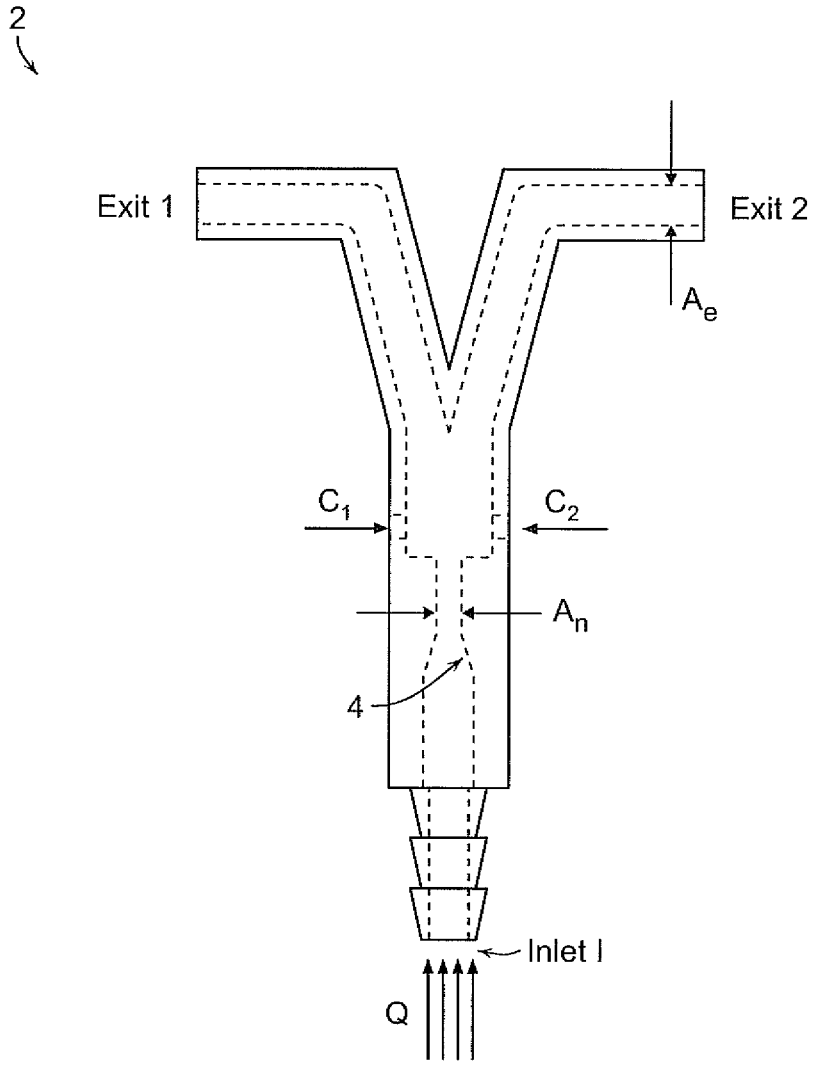
FIG. 1 is a schematic diagram illustrating a Coanda effect valve used in accordance with the invention.

FIG. 1 shows a schematic diagram illustrating a Coanda effect valve 2. A high pressure water supply (volume flow rate Q) is supplied to inlet I which goes through a nozzle 4 of area $A_n$. Depending on the pressures at the two control ports ($C_1$, $C_2$), the water jet attaches to either the left or right wall and then exits through either exit (Exits 1 and 2) having an area $A_e$. The control ports ($C_1$, $C_2$) use the Coanda effect to switch the direction of the water jet between Exits 1 and 2. When a control port $C_1$ or $C_2$ is opened, ambient fluid is entrained causing the jet to move towards the opposite wall. This process eventually causes the jet to attach to the opposite wall. Therefore, if control port $C_1$ is opened ($C_2$ must remain closed) the water jet can bend towards the right wall, attach to the wall, and exit through Exit 2. It should be noted that these valves do have pressure losses associated with them due to the exit area being larger than the nozzle area. The theoretical flow coefficient ($C_v$) for these valves (~0.55) substantially exceeds those of comparable conventional solenoid valves.

Figure 2A:
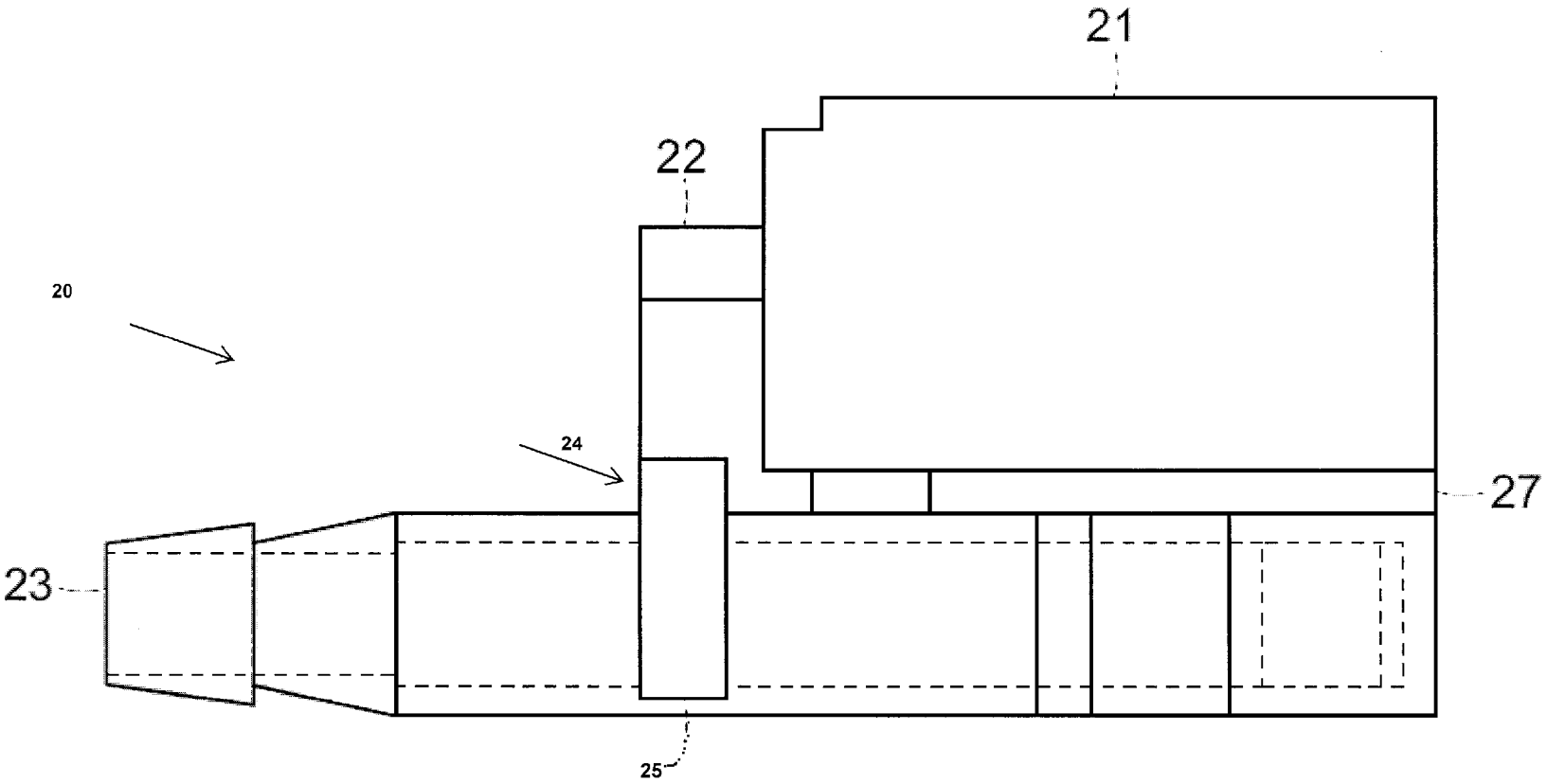
FIGS. 2A-2B are schematic diagrams illustrating a CJD formed in accordance with the invention.
Figure 2B:
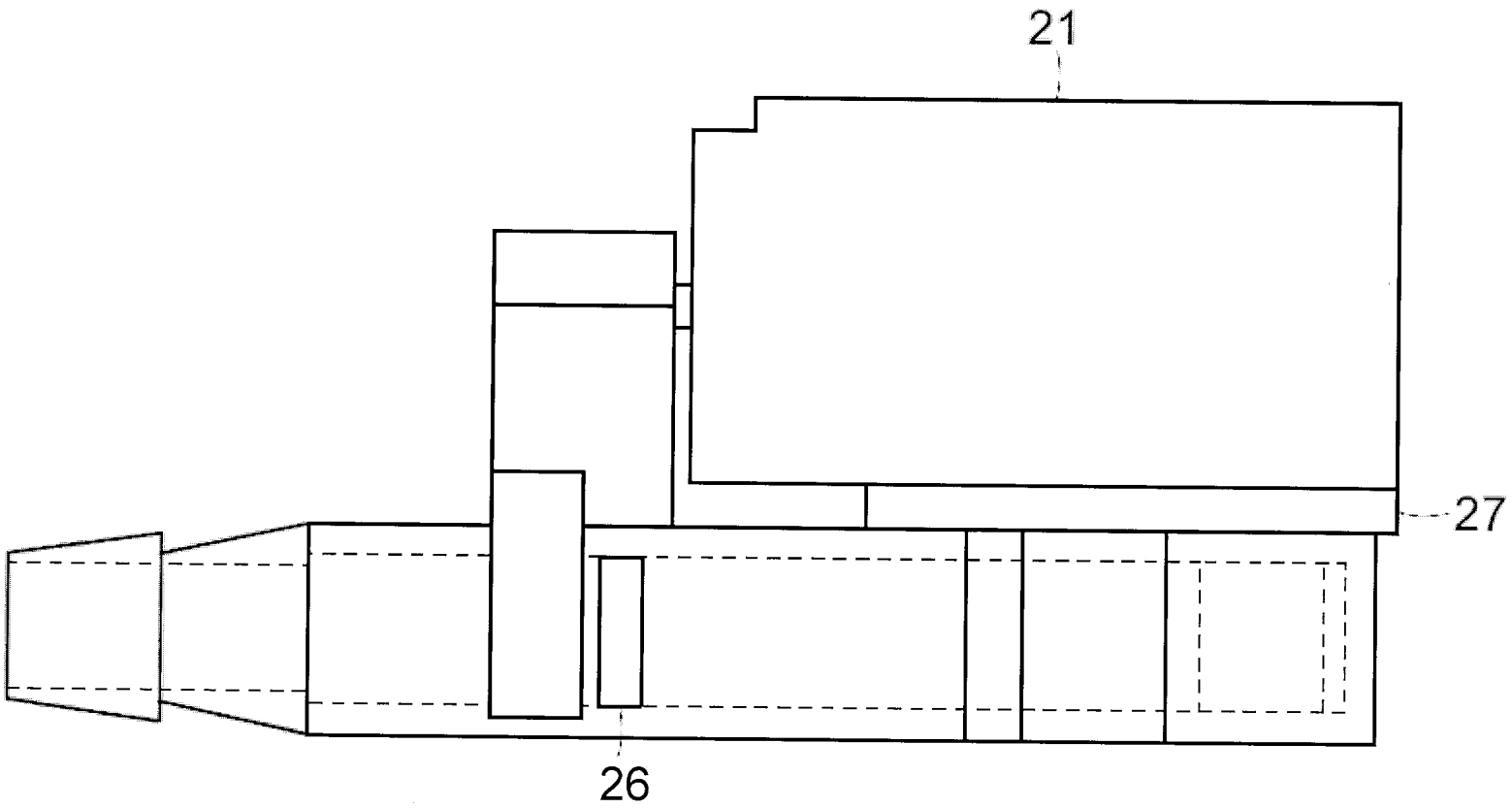

FIGS. 2A-2B illustrates a CJD 20. FIG. 2A shows fluid flowing into the device 20 through the inlet 23. A custom designed plastic piece 22 is used to cover one control port 25 while exposing the other control port 24 to ambient pressure. This pressure differential is sufficient to cause the jet to switch directions. When a solenoid 21 is activated the push rod 27 moves forward and the situation is reversed. With respect to the figure, when the solenoid 21 is inactive the control port 25 facing the reader 26 is covered, the fluid jet exits out of the page. When the solenoid 21 is activated the control port 24 facing away is covered while the control port 25 is opened, as shown in FIG. 2B. Therefore the jet exits into the page. This simple design enables the switching of the jet with a compact solenoid 21 and at high speed. The simplicity of this approach should not be underestimated; the weight of the entire CJD 20 is ~25 grams.

Figure 3:
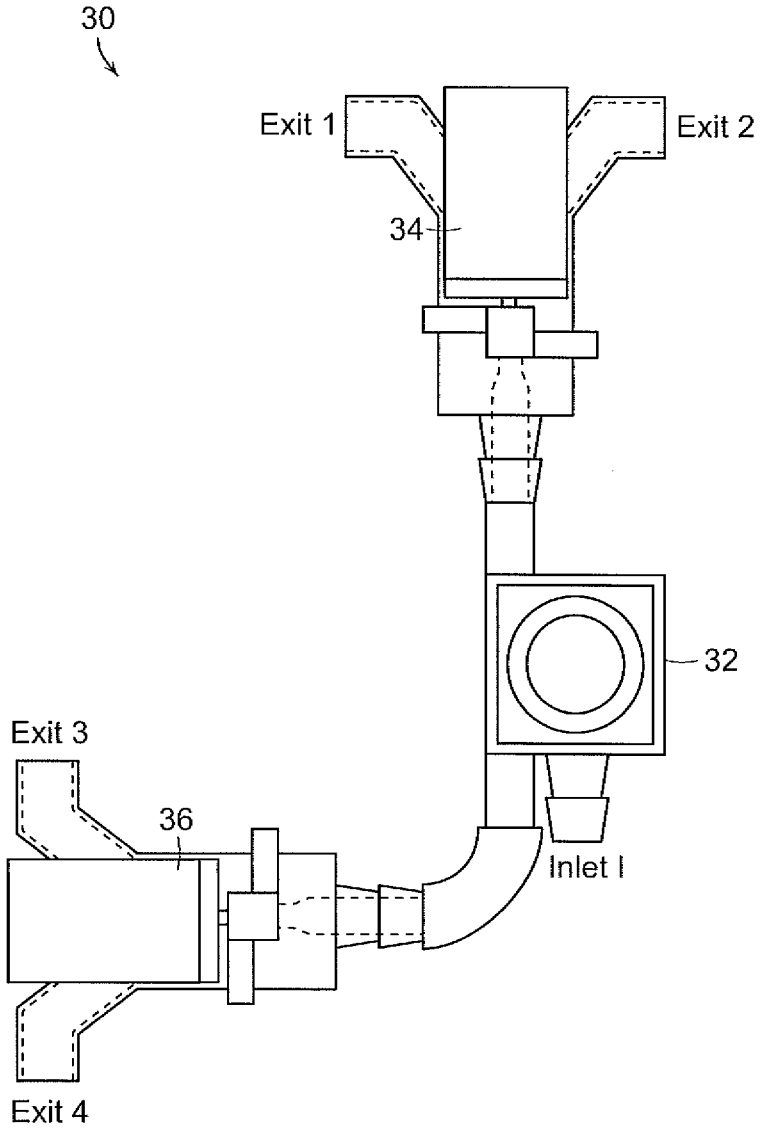
FIG. 3 is a schematic diagram illustrating a multi-axis architecture used in accordance with the invention.

FIG. 3 is a schematic diagram illustrating a multi-axis architecture 30 used in accordance with the invention. A single reversible pump 32 is used in tandem with two CJDs 34, 36 to enable the water jet to be switched at high speed between the four exit ports (Exits 1-4). Water is ingested through inlet I and then depending on the direction of the pump 32 and the configuration of the CJDs 34, 36, water can be ejected through Exits 1, 2, 3, or 4. Note that switching between Exits 1 and 2 or Exits 3 and 4 can be done simply by switching a solenoid. Other switches, such as Exits 1 to 3 or Exits 2 to 4, require the reversal of the pump 32.

Figure 4:
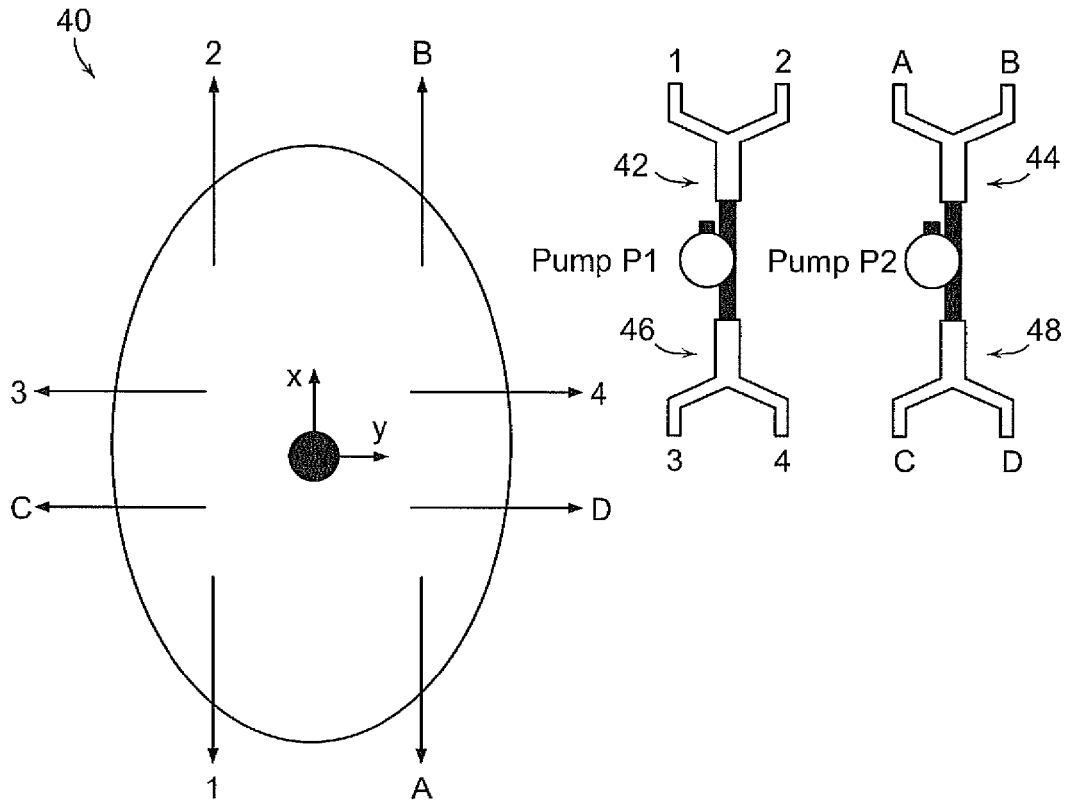
FIG. 4 is a schematic diagram illustrating a valve architecture having a set of reversible pumps and CJDs.

FIG. 4 is a schematic diagram illustrating a valve architecture 40 with a set of reversible pumps P1, P2 and Coanda Jet Devices (CJDs) 42, 44, 46, 48. The valve architecture 40 is used to achieve maneuvering within the plane of a vehicle (xy plane). The pumps P1, P2 are assumed to be reversible pumps. The jets 1, 2, A, B, can be used for motion in the x direction and for control of the orientation (yaw) of the vehicle. Note that this mode can be controlled without reversing the direction of either pump P1 or P2. This means that the while the solenoids can be switching back and forth at a high frequency to achieve precise control, the pumps P1, P2 cannot. This is desirable because a pump like a propeller has undesirable qualities when switched back and forth. To control motions in the y direction, the jets 3, 4, C, D can be used. Note that in this mode the orientation can still be controlled.

Figure 5:
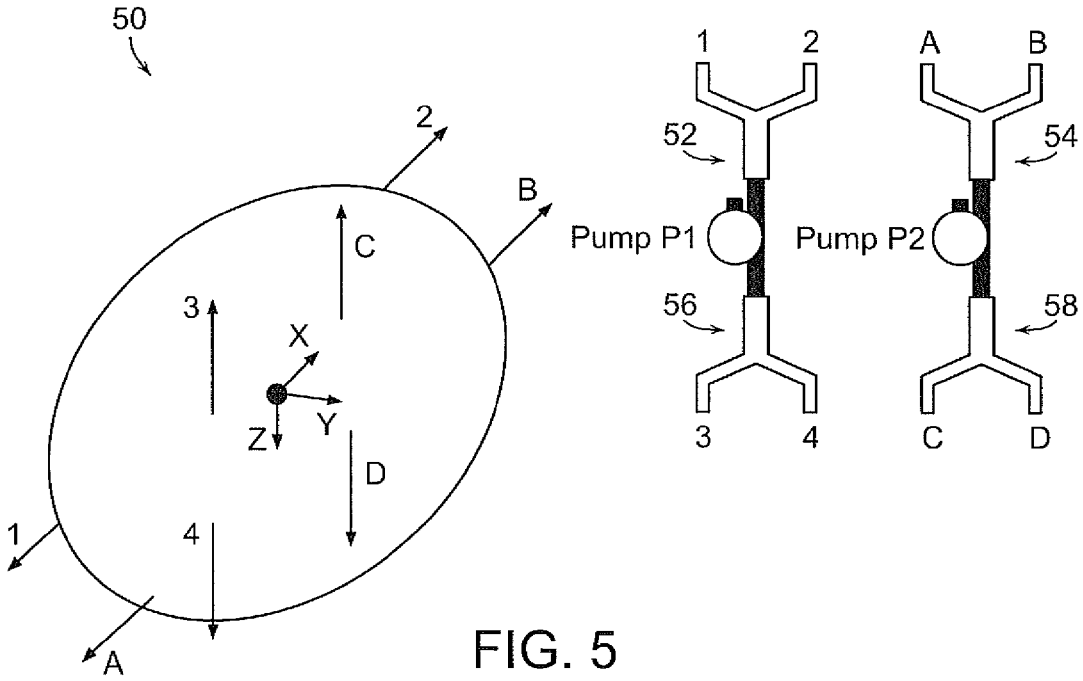
FIG. 5 is a schematic diagram illustrating a valve architecture having a set of reversible pumps and CJDs for use in three dimensional motion.

FIG. 5 is a schematic diagram illustrating a valve architecture 50 with a set of reversible pumps P1, P2 and CJDs 52, 54, 56, 58. This design is intended for three dimensional motions. The pumps P1, P2 are assumed to be a reversible pumps. The jets 1, 2, A, B, can be used for motion in the x direction and for control of the orientation (yaw) of the vehicle. Note that this mode can be controlled without reversing the direction of either pump P1 or P2. This means that the while the solenoids can be switching back and forth at a high frequency to achieve precise control, the pumps P1, P2 cannot. This is desirable because a pump like a propeller has undesirable qualities when switched back and forth. To control motions in the z direction, the jets 3, 4, C, D can be used. In addition rotations about the y axis (pitch) can also be controlled.

Figure 6:
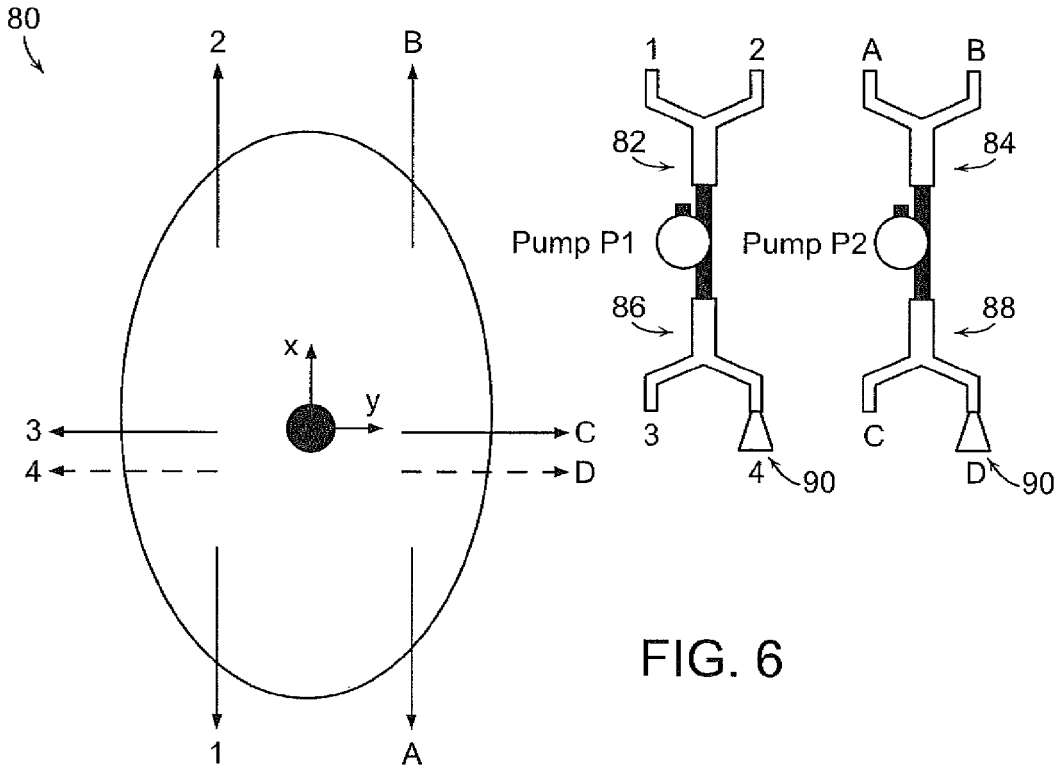
FIG. 6 is a schematic diagram illustrating a valve architecture having a set of reversible pumps and CJDs in a null configuration.

FIG. 6 is a schematic diagram illustrating a valve architecture 80 with a set of reversible pumps P1, P2 and CJDs 82, 84, 86, 88. This valve architecture 80 is used to achieve maneuvering within the plane of the vehicle (xy plane). The pumps P1, P2 are assumed to be reversible pumps. The difference in jet 4 and jet D is the use of a diverging nozzle 90 on the jet outlet to indicate that a large exit area exists that reduces the force of the jet to be approximately zero. This arrangement is a null configuration that can be used to impose zero force without having to turn the pump off. The reason for this is that some pumps introduce nonlinear and dynamic effects when turned on and off, and this could complicate control. The jets 1, 2, A, B, can be used for motion in the x direction and for control of the orientation (yaw) of the vehicle.

This mode can be controlled without reversing the direction of either pump P1, P2. This means that the while the solenoids can be switching back and forth at a high frequency to achieve precise control, the pumps P1, P2 cannot. This is desirable because a pump like a propeller has undesirable qualities when switched back and forth. To control translational motions in the y direction, the jets 3, 4, C, D can be used. Note that the key difference in this architecture that when the vehicle is in y translation mode the orientation cannot be controlled by the outlets 3, 4, C, D.

Figure 7:
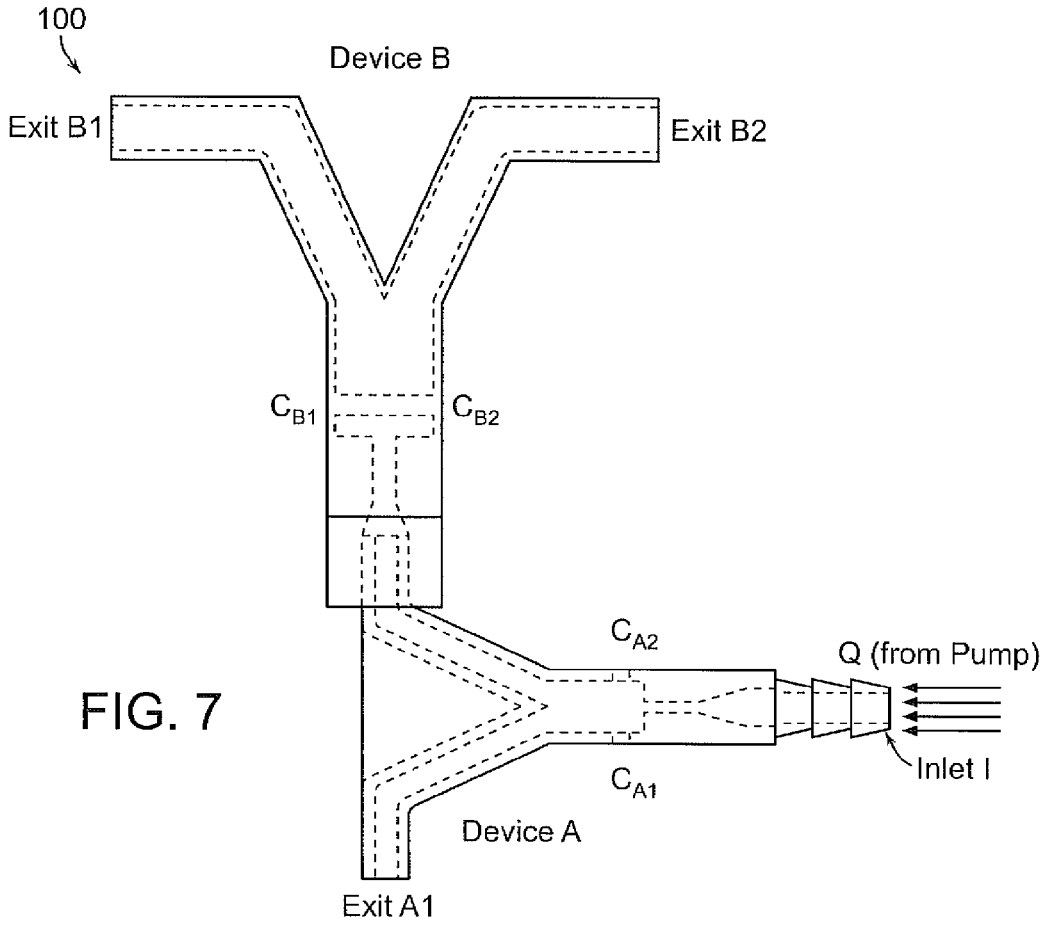
FIG. 7 is a schematic diagram illustrating a tree structure using CJDs in accordance with the invention.

FIG. 7 is a schematic diagram illustrating a tree structure 100 using CDs (Device A, Device B). A high pressure water supply (volume flow rate Q) is supplied to Device A at inlet I. Depending on the pressures at the two control ports $C_{A1}$ or $C_{A2}$, the jet either exits through Exit A1 or enters Device B. If the jet enters Device B the control ports $C_{B1}$, and $C_{B2}$ can be used to switch between Exit B1 and Exit B2. Note one of the exits of Device A is connected to one of the exits of Device B. Therefore with this tree structure 100, three distinct choices now exist for the water jet. A third device can be added at Exit A1 and increase this number to four.

Figure 8:
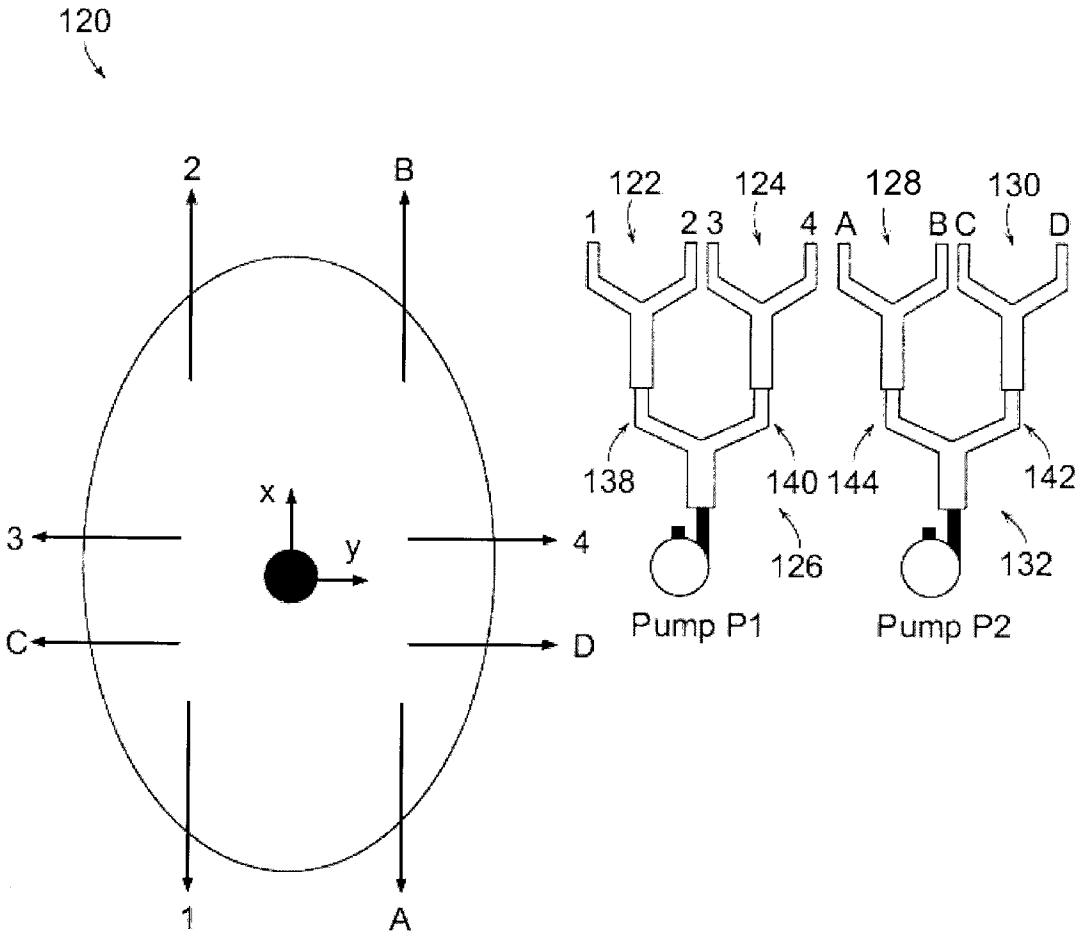
FIG. 8 is a schematic diagram illustrating a valve architecture with a set of non reversible pumps and tree structures formed in accordance with the invention.

FIG. 8 is a schematic diagram illustrating a valve architecture 120 with a set of non reversible pumps P1 and P2 and four tree structures 138, 140, 142, 144. The valve architecture 120 is used to achieve maneuvering within the plane of the vehicle (xy plane). In this case the pumps P1, P2 are assumed to be one way (not reversible). This condition is considered because most simple pumps P1, P2, such as centrifugal pumps, are not designed to be reversible. The tree structures 138, 140 are formed by coupling the exits of the CJD 126 to one of the exits of the CJD 122, 124. The tree structures 142, 144 are formed by coupling the exits of the CJD 132 to one of the exits of both CJD 128, 130. The jets 1, 2, A, B, can be used for motion in the x direction and for control of the orientation (yaw) of the vehicle. To control translational motions in the y direction, the jets 3, 4, C, D can be used. The chief benefit to this design is that the pumps P1, P2 do not need to be reversible.

Figure 9:
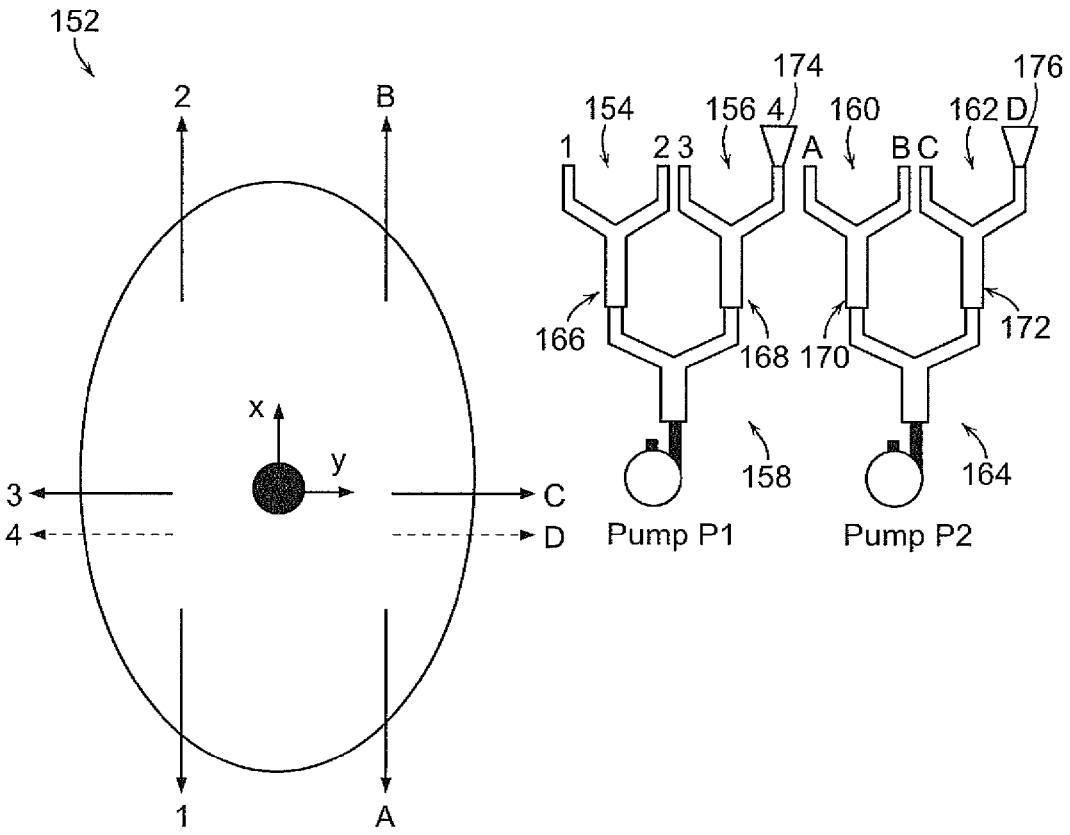
FIG. 9 is a schematic diagram illustrating a valve architecture with a set of non reversible pumps and tree structures in a null configuration formed in accordance with the invention.

FIG. 9 is a schematic diagram illustrating a valve architecture 152 with a set of non reversible pumps P1, P2 and 4 tree structures 166, 168, 170, 172. The valve architecture 152 achieves maneuvering within the plane of the vehicle (xy plane). In this case the pumps P1, P2 are assumed to be one way (not reversible). This condition is considered because most simple pumps, such as centrifugal pumps, are not designed to be reversible. The tree structures 166, 168 are formed by coupling the two exits of the CJD 158 to one of the exits of the CJDs 154, 156. The tree structures 170, 172 are formed by coupling the two exits of the CJD 164 to one of the exits of both CJD 160, 162. This architecture 152 includes the null configuration having diverging nozzles 174, 176 on jets 4 and D. The jets 1, 2, A, B, can be used for motion in the x direction and for control of the orientation (yaw) of the vehicle. To control translational motions in the y direction, the jets 3, 4, C, D can be used. The chief benefit to this design is that the pumps do not need to be reversible.

Figure 10:
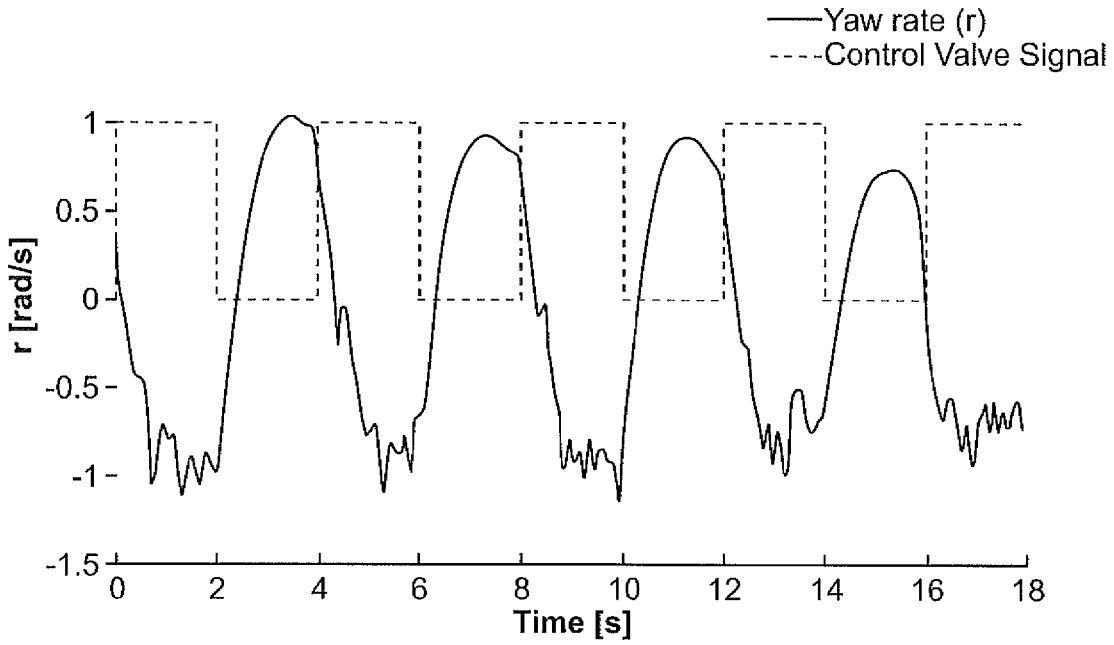
FIG. 10 is a graph illustrating experimental results of the invention using the tree structures described in FIG. 9.

FIG. 10 is a graph illustrating experimental results of the invention using the tree structures 166, 168, 170, 172 described in connection with FIG. 9. A simple floating vehicle was used for these measurements and a gyroscope integrated circuit was used to measure the yaw rate. This experiment illustrates that the output forces from the nested tree structure are still sufficient to maneuver a vehicle.

Figure 11A:
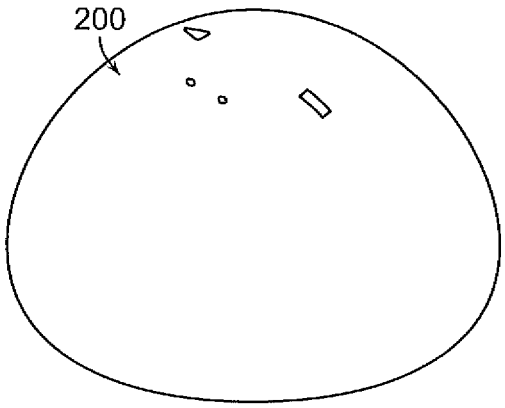
FIGS. 11A-11B are schematic diagrams illustrating an actuator skin and robot formed in accordance with the invention.
Figure 11B:
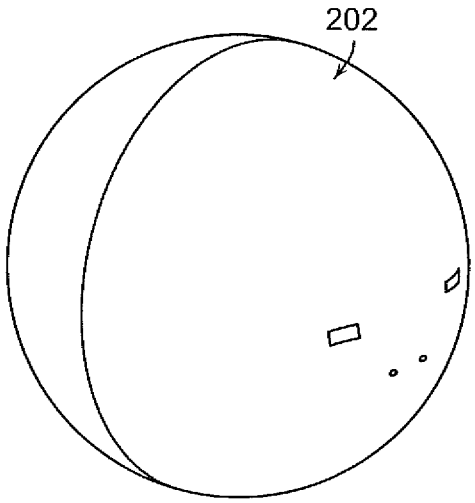

FIGS. 11A-11B are schematic diagrams illustrating an actuator skin 200 and robot 202 formed in accordance with the invention. A CJD structure can be incorporated into a skin or shell of an underwater robot. FIG. 11A illustrates the smooth shaped actuator skin or shell 200 where a CJD can be positioned inside. FIG. 11B shows an actual robot 202 formed using the smooth shaped actuator skin or shell 200 where a CJD can be positioned in the interior region of the robot 202. This type of geometry is now possible due to advances in 3D printing technology.

The invention provides for multi-axis underwater vehicle control by simply switching between two outputs. The inventive architecture uses a number of valves to create forces and moments that can result in translations and rotations along multiple axes while also allowing for the use of a diffuser nozzle to create a null configuration. This allows a pump to remain on while applying zero force or moment to the vehicle.

Although the present invention has been shown and described with respect to several preferred embodiments thereof, various changes, omissions and additions to the form and detail thereof, may be made therein, without departing from the spirit and scope of the invention.

What is claimed is:

1. A Coanda jet propulsion system comprising:

one or more pumps that form a jet for propulsion; and a plurality of Coanda jet devices (CJDs) coupled to the one or more pumps, each CJD having a single solenoid, the CJDs are arranged so to allow for a multi-axis underwater control of an underwater robot, the CJDs incorporate a set of compact valves allowing an operator to choose which direction and axis to apply force and moments, said one or more pumps ingest fluid through an inlet before said fluid is ejected through an exit of said CJDs by operation of said one or more pumps and configuration of said plurality of CJDs, each of said CJDs include a plurality of control ports to switch directions of said fluid to exit through said CJDs using said single solenoid and a plastic piece coupled to a pushrod, said plastic piece covers either a first control port or a second control port while exposing the uncovered control port to ambient pressure producing a pressure differential that causes the jet to switch directions, wherein when the solenoid is inactive the first control port is covered and the jet exits out of the second control port, and when the solenoid is activated the pushrod moves the plastic piece to cover the second control port and the jet exits out of the first control port.

2. The propulsion system of claim 1, wherein the one or more pumps comprise a plurality of reversible pumps where the CJDs are coupled to each outlet of the reversible pumps.

3. The propulsion system of claim 2, wherein the CJDs allow for translation in a plurality of directions and rotation on one or more axes.

4. The propulsion system of claim 3 further comprising one more diverging nozzles that are positioned on an output of the CJDs.

5. The propulsion system of claim 1, wherein the one or more pumps comprise a plurality of one-way pumps where the CJDs are coupled to each other to form one or more tree structures.

6. The propulsion system of claim 5, wherein the tree structures comprise coupling exits of one of the CJD to at least one exit of the remaining CJDs.

7. The propulsion system of claim 6, wherein the tree structures allow for translation in a plurality of directions and rotation on one or more axes.

8. The propulsion system of claim 7 further comprising one more diverging nozzles that are positioned on an output of the CJDs.

9. A method of forming a Coanda jet propulsion system comprising:

one or more pumps that form a jet for propulsion; and coupling a plurality of Coanda jet devices (CJDs) to the one or more pumps, each CJD having a single solenoid, the CJDs are arranged so to allow for a multi-axis underwater control of an underwater robot, the CJDs incorporate a set of compact valves allowing an operator to choose which direction and axis to apply force and moments, said one or more pumps ingest fluid through an inlet before said fluid is ejected through an exit of said CJDs by direction of said one or more pumps and configuration of said plurality of CJDs, each of said CJDs include a plurality of control ports to switch directions of said CJDs using said single solenoid and a plastic piece coupled to a pushrod, said plastic piece covers either a first control port or a second control port while exposing the uncovered control port to ambient pressure producing a pressure differential that causes the jet to switch directions, wherein when the solenoid is inactive the first control port is covered and the jet exits out of the second control port, and when the solenoid is activated the pushrod moves the plastic piece to cover the second control port and the jet exits out of the first control port.

10. The method of claim 9, wherein the one or more pumps comprise a plurality of reversible pumps where the CJDs are coupled to each outlet of the reversible pumps.

11. The method of claim 10, wherein the CJDs allow for translation in a plurality of directions and rotation on one or more axes.

12. The method of claim 11 further comprising one more diverging nozzles that are positioned on an output of the CJDs.

13. The method of claim 9, wherein the one or more pumps comprise a plurality of one-way pumps where the CJDs are coupled to each other to form one or more tree structures.

14. The method of claim 13, wherein the tree structures comprise coupling exits of one of the CJD to at least one exit of the remaining CJDs.

15. The method of claim 14, wherein the tree structures allow for translation in a plurality of directions and rotation on one or more axes.

16. The method of claim 15 further comprising one more diverging nozzles that are positioned on an output of the CJDs.

17. A method of performing the operation of a propulsion system comprising:

forming a jet for propulsion using one or more pumps; and providing multi-axis underwater control using a plurality of Coanda jet devices (CJDs), the CJDs are coupled to the one or more pumps, each CJD having a single solenoid, the CJDs incorporate a set of compact valves allowing an operator to choose which direction and axis to apply force and moments, said one or more pumps ingest fluid through an inlet before said fluid is ejected through an exit of said CJDs by direction of said one or more pumps and configuration of said plurality of CJDs, each of said CJDs include a plurality of control ports to switch directions of said CJDs using said single solenoid and a plastic piece coupled to a pushrod, said plastic piece covers either a first control port or a second control port while exposing the uncovered control port to ambient pressure producing a pressure differential that causes the jet to switch directions, wherein when the solenoid is inactive the first control port is covered and the jet exits out of the second control port, and when the solenoid is activated the pushrod moves the plastic piece to cover the second control port and the jet exits out of the first control port.

18. The method of claim 17, wherein the one or more pumps comprise a plurality of reversible pumps where the CJDs are coupled to each outlet of the reversible pumps.

19. The method of claim 18, wherein the CJDs allow for translation in a plurality of directions and rotation on one or more axes.

20. The method of claim 19 further comprising one more diverging nozzles that are positioned on an output of the CJDs.

21. The method of claim 17, wherein the one or more pumps comprise a plurality of one-way pumps where the CJDs are coupled to each other to form one or more tree structures.

22. The method of claim 21, wherein the tree structures comprise coupling exits of one of the CJD to at least one exit of the remaining CJDs.

23. The method of claim 22, wherein the tree structures allow for translation in a plurality of directions and rotation on one or more axes.

24. The method of claim 23 further comprising one more diverging nozzles that are positioned on an output of the CJDs.

* * * * *